US005319996A

United States Patent [19]

Harris

[11] Patent Number: 5,319,996

[45] Date of Patent: Jun. 14, 1994

[54] DEBRIS RESISTANT FOOT PEDAL SWITCH ASSEMBLY

[75] Inventor: Timothy S. Harris, Fort Wayne, Ind.

[73] Assignee: Kransco, San Francisco, Calif.

[21] Appl. No.: 106,403

[22] Filed: Aug. 13, 1993

[51] Int. Cl.[5] ..... G05G 1/14; H01H 21/24

[52] U.S. Cl. ..... 74/560; 74/512; 200/330; 200/332.1; 200/339; 200/557

[58] Field of Search ..... 74/560-563, 74/512-514; 200/330, 332.1, 339, 557

[56] References Cited

U.S. PATENT DOCUMENTS

| | | | |
|---|---|---|---|
| 2,795,144 | 6/1957 | Morse | 74/17.8 |
| 3,328,740 | 6/1967 | Thompson et al. | 74/560 |
| 3,353,424 | 11/1967 | Peterson et al. | 74/560 |
| 3,667,316 | 6/1972 | Valletti et al. | 74/560 |
| 3,767,022 | 10/1973 | Olson | 200/168 X |
| 3,780,249 | 12/1973 | Harper | 200/168 G |
| 3,821,534 | 6/1974 | Mehner et al. | 200/338 |
| 3,829,632 | 8/1974 | Klehm, Jr. | 200/5 A |
| 3,858,012 | 12/1974 | Lockard | 200/16 D |
| 3,916,722 | 11/1975 | Grobe | 74/512 |
| 4,182,198 | 1/1980 | Dartnell | 74/513 |
| 4,380,002 | 4/1983 | Neill et al. | 74/560 |
| 4,453,061 | 6/1984 | Tamura | 200/306 |
| 4,510,906 | 4/1985 | Klatt | 74/560 X |
| 4,631,033 | 12/1986 | Menne | 74/512 X |
| 4,695,819 | 9/1987 | Bowsher | 74/512 X |
| 4,836,531 | 6/1989 | Niks | 74/560 X |
| 4,837,857 | 6/1989 | Scheller et al. | 74/560 X |
| 4,937,407 | 6/1990 | Osika | 200/302.3 |
| 5,051,550 | 9/1991 | Harris | 200/330 |
| 5,117,074 | 5/1992 | Yanai et al. | 200/302.3 |

FOREIGN PATENT DOCUMENTS

| | | | |
|---|---|---|---|
| 2-59913 | 2/1990 | Japan | 74/560 |

*Primary Examiner*—Vinh T. Luong
*Attorney, Agent, or Firm*—Kolisch, Hartwell, Dickinson, McCormack & Heuser

[57] ABSTRACT

An foot pedal switch assembly including a panel for mounting a foot pedal and a switching mechanism, wherein the panel includes a debris fence surrounding the switching mechanism and the pedal has a cap structure molded in the bottom to telescopically engage around the debris fence forming a substantially continuous barrier to the entry of dust and debris into the switching mechanism.

10 Claims, 1 Drawing Sheet

DEBRIS RESISTANT FOOT PEDAL SWITCH ASSEMBLY

BACKGROUND AND SUMMARY OF THE INVENTION

The present invention relates to a foot pedal switch assembly, and more particularly to a foot pedal switch assembly with improved resistance to the entry of dust and foreign material into the switching mechanism and the area around that mechanism. The foot pedal switch assembly has particular applicability for use as an actuation device to interconnect a battery with a motor to provide power, for example, on toys such as ride on vehicles for children.

A significant problem with foot pedal switch assemblies currently used in children's battery-powered vehicles involves contamination and fouling of the switching mechanism by debris and dust. Contamination of the switching mechanism can lead to an inoperable device, or worse, jamming of the switching mechanism in the on state.

With the above problems in mind, it is a general object of the present invention to provide a novel structure for a foot pedal switch assembly with improved resistance to entry of foreign matter into the switching mechanism.

It is another object of the present invention to provide a structure that achieves the above result and yet is economical to manufacture by virtue of having relatively few parts, featuring components readily moldable from plastic, and not requiring precisely fitting parts.

Yet another object of the invention is to provide a structure that is rugged enough to tolerate the abuses expected in the operating environment.

DETAILED DESCRIPTION OF THE PREFERRED EMBODIMENTS

Figure 1:
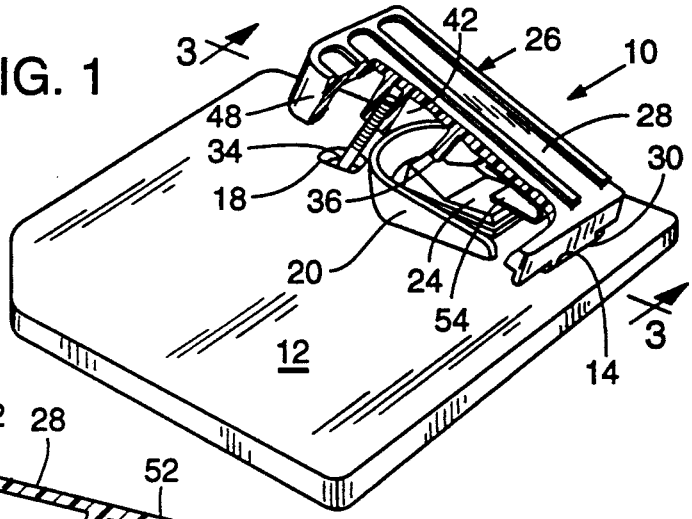
FIG. 1 is a perspective view of the foot pedal switch assembly.
Figure 3:
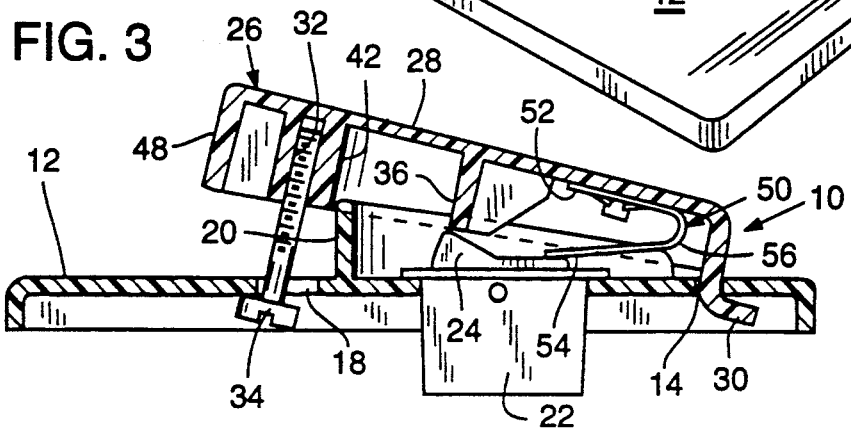
FIG. 3 is a cross sectional side view of the foot pedal switch assembly along the line 3—3 in FIG. 1.
Figure 2:
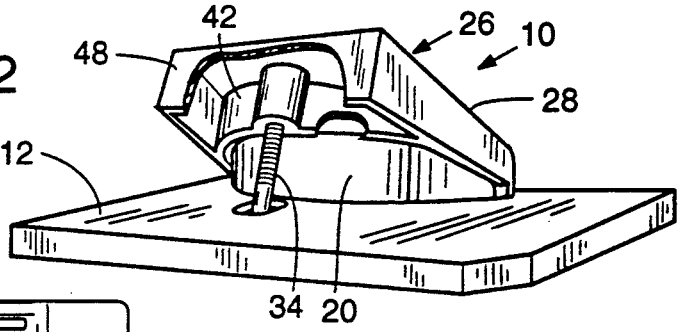
FIG. 2 is a perspective view of the foot pedal switch assembly showing the telescopic engagement of a foot pedal with a debris fence.

As shown in FIGS. 1 and 2, a foot pedal switch assembly according to the present invention is generally indicated at 10.

The assembly 10 includes a panel 12, which may be and preferably is, molded from stiff plastic, and may be mounted as part of the floor board of a child's ride-on vehicle, for example. The panel 12 is provided with a pivot slot 14, a switch opening 16, and an pedal retainer slot 18, as shown in FIG. 4.

Figure 4:
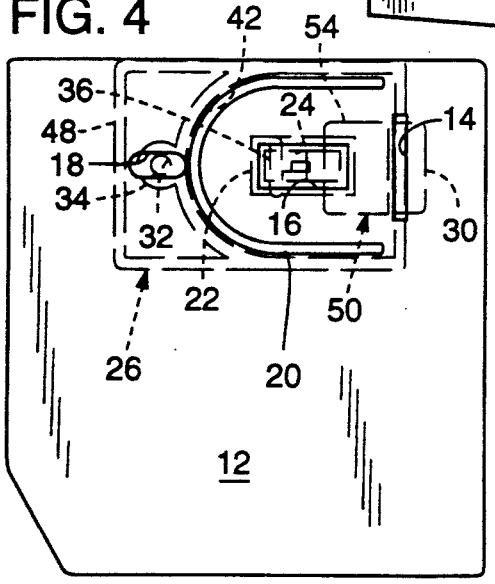
FIG. 4 is a top view of a panel showing the course of the debris fence.

A U-shaped debris fence 20, integrally molded with, and extending upwardly from, the panel 12, surrounds the switch opening 16 on three sides with the open end of the U facing the pivot slot 14, as shown in FIGS. 2 and 4.

An On-off rocker switching mechanism 22, of conventional construction is mounted in the switch opening 16 in the panel 12. The switching mechanism 22 includes a rocker 24 for control of the state of the switching mechanism, said switching mechanism 22 being internally biased so that it returns to the off position in the absence of an actuating force on the rocker 24.

A pedal 26, which may be, and preferably is, molded from stiff plastic, having a substantially flat treaded top 28, is pivotally disposed on the panel 12 over the switching mechanism 22 via a hook 30 insertable in the pivot slot 18 allowing the pedal 26 to be pivoted relative to the panel 12. The pedal 26 includes a downwardly facing threaded sleeve 32, disposed on the centerline of the pedal 26 near the end of the pedal 26 opposite the hook 30. The threaded sleeve 32 receives a screw 34 which extends through the pedal retainer slot 18. The screw 34 serves to limit the extent to which the pedal 26 may be pivoted up from the panel 12. The pedal 26 also includes a downwardly extending finger 36 disposed above the rocker 24 so that depression of the pedal 26 biases the finger 36 against the rocker 24, actuating the switching mechanism 22.

Figure 5:
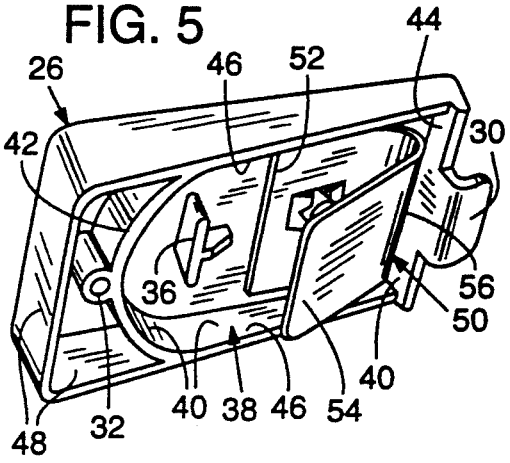
FIG. 5 is a perspective view of the bottom of the pedal showing a cap structure in the bottom of the pedal.

The lower side of the pedal 26 includes a cap 38 designed to telescopically engage around the debris fence 20 as the pedal 26 is depressed, as is shown in FIG. 5. The cap 38 includes a perimeter skirt 40 having a front 42, back 44, and sides 46 projecting downwardly from the top 28 and closely following the contour of the outside of the debris fence 20. The back 44 of the perimeter skirt 40 spans the open end of the debris fence 20 and runs along the back of the pedal 26. A toe skirt 48 extends downwardly from the front section of the top 28, running along the edges of the front portion of the top and connecting continuously with the sides 46 of the perimeter skirt 40 to form a substantially continuous edge around the pedal 26.

The assembly 10 also includes a generally U-shaped clip spring 50 having a first side 52, a second side 54 and a round end 56. The first side 52 is attached to the side of the top 28 on the surface facing the panel 12, with the round end 56 being disposed proximal to the hook 32. The second side 54 makes contact with the rocker 24 and biases it towards the off position. The clip spring 50 acts as a backup to the internal biasing mechanism of the switching mechanism 22 to ensure the switching mechanism 22 returns to the off state when the pedal 26 is released. The clip spring 50 also serves to bias the pedal 26 towards the raised position.

The depth of the perimeter skirt 40, the height of the debris fence 20, and the amount of pedal pivot allowed by the screw 36 are matched so that the perimeter skirt 40 and the debris fence 20 overlap in both the raised and depressed positions of the pedal 26.

While the present invention has been shown and described with reference to the foregoing preferred embodiment, it is to be understood by those skilled in the art that other changes in form and detail may be made therein without departing from the spirit and scope of the invention as defined in the appended claims.

It is claimed and desired to secure by Letters Patent:

1. A foot pedal switch assembly comprising:

a switching mechanism;

a panel having an opening extending therethrough in which said switching mechanism is disposed, wherein the switching mechanism is accessible through the opening;

an upstanding rigid debris fence fixedly attached to and rising from the panel and surrounding the opening on at least three sides for fending loose debris from said opening;

a pedal movably mounted on the panel and disposed over the switching mechanism so that the pedal selectively actuates and de-actuates the switching mechanism; and a cap attached to and extending downwardly from the bottom of the pedal and positioned to telescopically interfit with the debris fence.

2. The assembly of claim 1 wherein said pedal has a pivoted end and a free end, said pivoted end being hingedly attached to said panel.

3. The assembly of claim 2 wherein the pedal has a top and the cap includes a substantially continuous perimeter skirt projecting downwardly from the top, said skirt running closely adjacent to the outside of the debris fence.

4. The assembly of claim 3 wherein the perimeter skirt has side sections disposed at the edges of the top on opposite sides, and the pedal has a toe skirt projecting downwardly from the edges of the top at the free end of the pedal and connecting continuously with the side sections of the perimeter skirt.

5. The assembly of claim 3 wherein the debris fence is open on the side adjacent to the pivoted end of the pedal.

6. The assembly of claim 5 wherein debris fence is U-shaped.

7. The assembly of claim 1 wherein the switching mechanism is resiliently biased to return to the original state in the absence of pressure on the foot pedal.

8. The assembly of claim 7 wherein the pedal has a raised position and a depressed position, and the lower edge of the cap overlaps the upper edge of the debris fence with the pedal in its raised position.

9. A foot pedal switch assembly comprising:

a panel section of stiff plastic material having an opening extending therethrough;

a switching mechanism disposed within said opening such that the mechanism is accessible through said opening;

an upstanding shallow debris fence of stiff plastic material integrally fixedly joined to said panel section for fending loose debris from said opening and having a pair of elongate side-protecting courses extending adjacent opposite sides of said opening and an interconnecting course joining adjacent ends of said side-protecting courses beyond one end of the opening;

a foot pedal of stiff plastic material hingedly connected to said panel section at a position located beyond the end of said opening opposite the said one end of the opening; and an elongate skirt integrally joined to an underside of said foot pedal and descending downwardly therefrom, extending in courses closely adjacent said side protecting and interconnecting courses of said debris fence.

10. The assembly of claim 9, where said skirt extends an enveloping relationship about the perimeter of said debris fence, the foot pedal swings relative to said panel section between raised and lowered position, and the skirt and debris fence maintain an overlapping relationship while the pedal is swung between said positions.

* * * * *